US005396668A

United States Patent [19]

Haatanen

[11] Patent Number: 5,396,668

[45] Date of Patent: Mar. 14, 1995

[54] SYSTEM FOR DISCHARGING WASTES

[75] Inventor: Rauno O. Haatanen, Hamburg, Germany

[73] Assignee: Sanivac Vakuumtechnik Gmbh, Hamburg, Germany

[21] Appl. No.: 133,195

[22] PCT Filed: Mar. 19, 1992

[86] PCT No.: PCT/EP92/00611

§ 371 Date: Oct. 19, 1993

§ 102(e) Date: Oct. 19, 1993

[87] PCT Pub. No.: WO92/18713

PCT Pub. Date: Oct. 29, 1992

[30] Foreign Application Priority Data

Apr. 23, 1991 [DE] Germany ..... 91 04 935.0
Nov. 11, 1991 [DE] Germany ..... 41 36 931.9

[51] Int. Cl.[6] ..... E03F 1/00

[52] U.S. Cl. ..... 4/431; 4/321; 4/323

[58] Field of Search ..... 4/431, 432, 433, 321, 4/322, 323

[56] References Cited

U.S. PATENT DOCUMENTS

| | | | |
|---|---|---|---|
| 3,643,265 | 2/1972 | Wiswell, Jr. | 4/431 |
| 3,720,962 | 3/1973 | Harrah | 4/431 |
| 4,286,342 | 9/1981 | Anthony | 4/431 |

FOREIGN PATENT DOCUMENTS

| | | | |
|---|---|---|---|
| 2050775 | 4/1971 | France . | |
| 2434241 | 3/1980 | France . | |
| 2578000 | 8/1986 | France | 4/431 |
| 3338845 | 5/1985 | Germany | 4/431 |
| 3932893 | 4/1990 | Germany . | |
| 104828 | 4/1990 | Japan | 4/431 |
| 2194260 | 3/1988 | United Kingdom . | |

*Primary Examiner*—Henry J. Recla
*Assistant Examiner*—Charles R. Eloshway
*Attorney, Agent, or Firm*—Varndell Legal Group

[57] ABSTRACT

A discharge system for discharging wastes from a unit producing such wastes, such as a toilet, is disclosed. The system includes a device for creating a partial vacuum, an intermediate container and a collecting basin connected together by pipelines and valves in an arrangement which permits the use of an immediate container having a relatively small volume thereby permitting the use of a smaller vacuum pump. The discharge system is particularly useful for rail-bound vehicles and overland buses.

5 Claims, 2 Drawing Sheets

FIG. 3
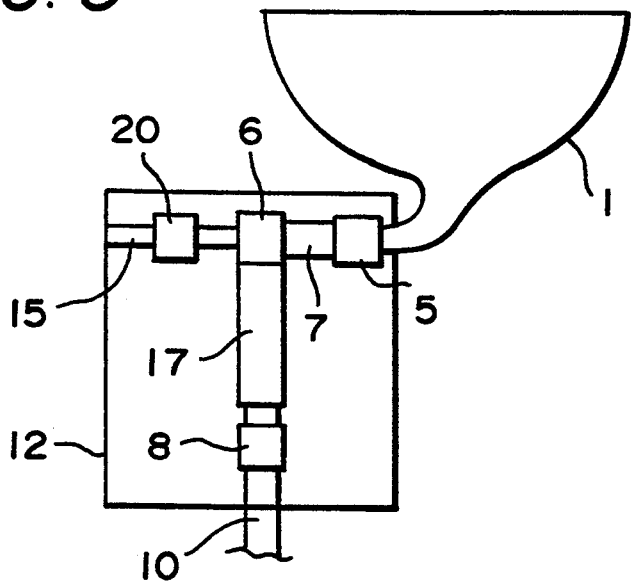
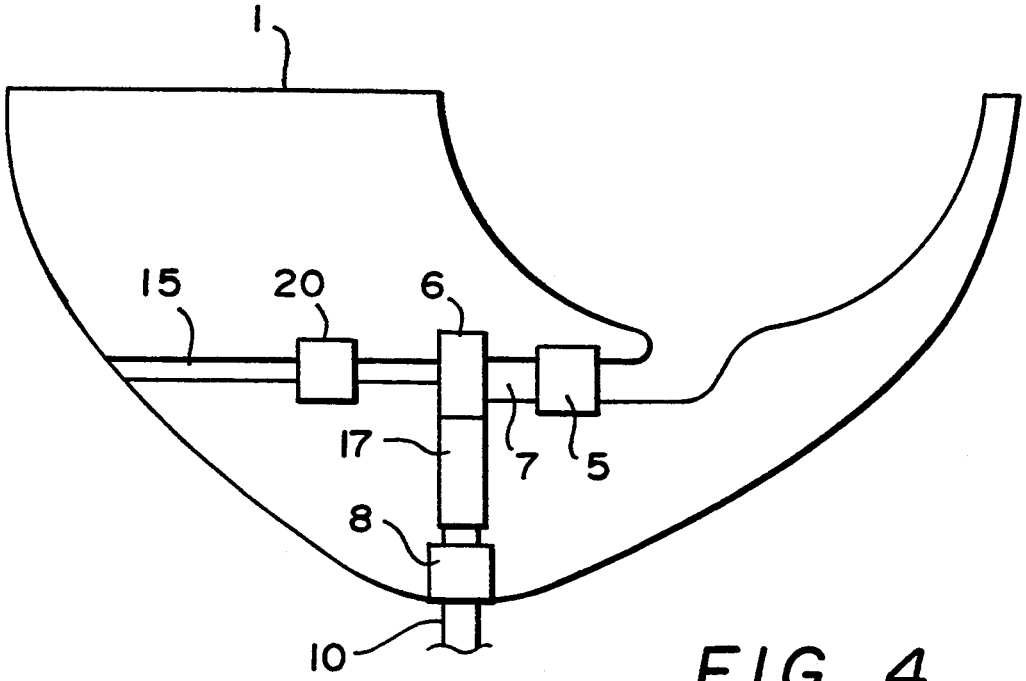
FIG. 4

SYSTEM FOR DISCHARGING WASTES

SYSTEM FOR DISCHARGING WASTES

The present invention is directed to a discharge system that discharges mass (wastes) from a unit producing such discharge mass (wastes). In particular, the present invention can be used for discharging wastes from a toilet basin in a vehicle. The present invention includes a device for creating a partial vacuum, an intermediate container and a collecting basin that are joined together by pipelines and valves.

BACKGROUND OF THE INVENTION

In a known discharge system of this type (DE-OS 39 32 893), air or gases are removed from the collecting basin and the intermediate container and fed into a pressure vessel. Furthermore, the pressure vessel, along with the vacuum in the intermediate container and collecting basin, ensures that the discharge mass makes it way into the collecting basin. However, the vacuum generator and the pressure vessel cannot be sized large enough to achieve this, such that there are doubts as to whether this known system even functions. Since the collecting basin has a relatively large volume, the vacuum pump would also have to be designed fairly large. In any case, because of this large volume, the unit producing the discharge mass would only be able to be used—if at all—at relatively long periods of time.

In the known system, there are also a number of devices necessary that make the entire system not only awkward and prone to trouble, but also quite costly.

SUMMARY OF THE INVENTION

The present invention is directed to a discharge system having a simplified design when compared to that discussed above and which has reduced costs of manufacture and operation.

BRIEF DESCRIPTIONS OF THE DRAWINGS

FIG. 3 shows a diagram of the discharge system of the present invention contained in a separate disposable block and attached to the unit producing the discharge mass or wastes.

FIG. 4 show a diagram of the discharge system of the present invention contained in the seat of a toilet basin.

DETAILED DESCRIPTION OF THE INVENTION

Figure 1:
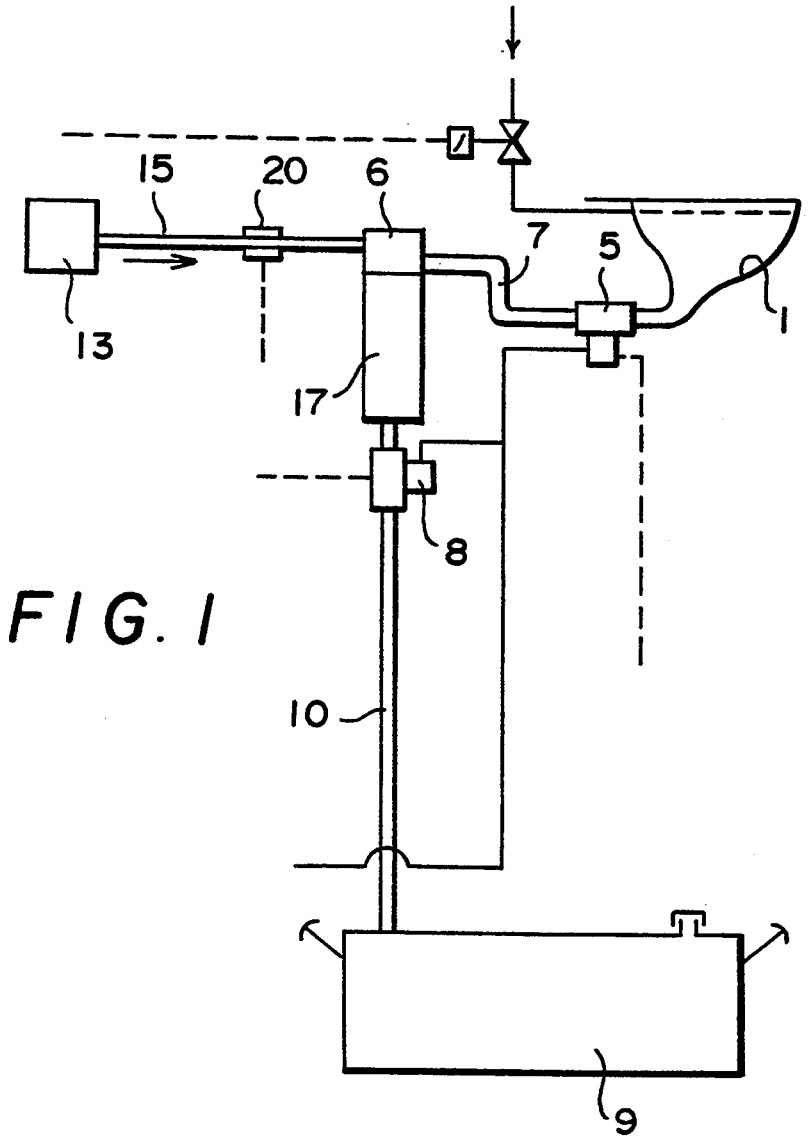
FIG. 1 shows a diagram of the discharge system of the present invention.

First of all, a significant advantage of the present invention is that a relatively small vacuum-creating device can be used. This is due to the fact that the intermediate container can have a relatively small volume, a matter of a few liters, and thus only a small volume needs to be evacuated. When the intermediate container is placed under sufficient vacuum, the discharge mass is sucked into the intermediate container, and thereafter by introducing compressed air into the intermediate container, the discharge mass or wastes contained in the intermediate container are pushed into the collecting basin. In this way the discharge system of the present invention can be manufactured at lower cost due in part to the use of a smaller vacuum pump. In addition, the discharge system of the present invention enables the unit producing the discharge mass to be operated at relatively short intervals of time.

The present invention will now be described by referring to FIG. 1 where a toilet basin 1 equipped with a known flushing system (not described in detail) is used as the unit for producing a discharge mass. At the discharge end of the toilet bowl 1 there is a valve 5 that leads via a pipe 7 to an intermediate container 17 in which a vacuum device, such as a vacuum pump, is arranged either in the immediate vicinity of the immediate container 17 or connected thereto by a short pipe with valve. The vacuum device 6 is designed in such a way that the interior of the intermediate container 17 can be evacuated quickly. Any gases sucked off or removed by the action of the vacuum device can also be fed into the collecting basin 9. An ejector can be used as the vacuum device that is activated via the already existing compressed air installation. Further, a pipe 15 leads into the collecting basin 17 via a valve 20, and this pipe is connected to the compressed air network or a compressed air generating means 13.

FIG. 1 shows in diagram form: control pipes for the valves as well as measuring and command pipes (in solid lines) that lead to a control (not shown). A typical operation of the discharge system of the present invention for removal of wastes from a toilet bowl will now be described by reference to FIG. 1. First, the actual flushing step is initiated, during which the valve 5 is closed. At this point in time the vacuum pump 6 has already evacuated the interior of the intermediate container 17 and valves 20 and 8 are closed. Next, valve 5 is opened in such a way that the discharge mass or wastes makes its way as a result of the partial vacuum (i.e. negative pressure) via the pipe 7 into the intermediate container 17. Then, the valve 5 is closed and valves 8 and 20 are opened in such a way that the compressed air pushes the discharge mass or wastes out of the intermediate container 17 into the collecting basin.

The collecting basin 9 can have a volume of 100 liters or more. On the other hand, the intermediate container 17 can have a content of a few liters, for example, 1–5 liters. Only a fraction of a liter of flush water (i.e., 0.1 to 0.9 liters) is needed for the flushing step itself in the discharge system according to the present invention.

Figure 2:
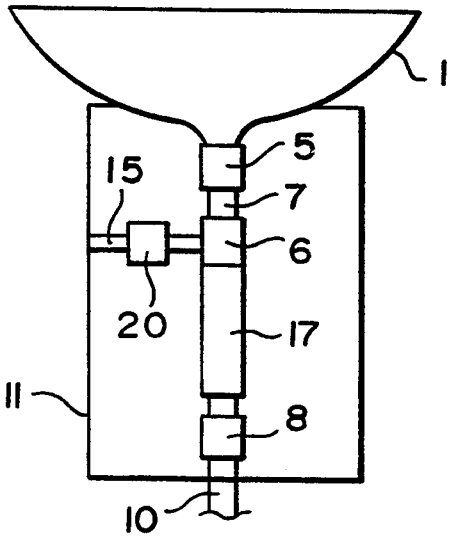
FIG. 2 shows a diagram of the discharge system of the present invention housed in the unit located on producing the discharge mass or wastes (i.e. a toilet).

FIGS. 2–4 show alternative arrangements for the discharge system of the present invention, where some or all of the pipes, all of the valves, the intermediate container and the vacuum device are arranged in the immediate vicinity of the toilet basin, i.e., either in the seat area (FIG. 4) or below the bowl in, for example, a housing 11 (FIG. 2). FIG. 3 show an arrangement where the discharge system of the present invention is contained within a disposable block or housing 12 secured to, for example, a toilet bowl. In the arrangements of FIGS. 2–4, the collecting bin 9 and the pipe 10 leading thereto can be located a distance from discharge system of the present invention. These arrangements are particularly significant when considering installations in vehicles in which space problems already occur. For example, the present invention is particularly useful for rail-bound vehicles and for overland buses.

In a preferred application of the present invention, the compressed air system already existing in rail vehicles can be use to provide the compressed air to pipe 15, where a pump with mechanically moving parts is not required, but rather an ejector can be used. This means that instead of mechanical pumps, only valves are needed. In addition, the on-board electrical system of rail-bound vehicles provides a relatively high pressure in such a way that on the one hand, the desired high vacuum output is possible and, on the other hand, the conveying step of the produced discharge mass from the Intermediate container into the discharge container can be carried out reliably. Finally, the fact that relatively little flushing water is needed in the discharge system of the present invention is particularly significant in the case of frost-endangered places.

I claim:

1. A discharge system comprising:

waste means for providing wastes to be discharged, intermediate container means for receiving said wastes connected to said waste means by a first pipe having a first valve, vacuum means directly attached and connected to said intermediate container means for creating at least a partial vacuum only in said intermediate container means and sucking said wastes into said intermediate container means, and compressed air means connected by a second pipe having a second valve to said intermediate container means for providing pressurized air and pushing said wastes out of said intermediate container means to a collecting basin through a third pipe having a third valve, wherein when said discharge system is flushed, said wastes are collected with said first valve closed, said wastes are transferred to said intermediate container means by said at least partial vacuum in said intermediate container means when said first valve is open and said second and third valves are closed, and said wastes are transferred to said collecting basin by said pushing when said first valve is closed and said second and third valves are open.

2. The discharge system according to claim 1, wherein said waste means includes a toilet, and said intermediate container means, said vacuum means, said first pipe, a portion of said second and third pipes and said first, second and third valves are arranged in a seat of said toilet.

3. The discharge system according to claim 1, wherein said intermediate container means, said vacuum means, said first pipe, a portion of said second and third pipes and said first, second and third valves are housed in a unit arranged below said waste means and on which said waste means sits.

4. The discharge system according to claim 1, wherein said intermediate container means, said vacuum means, said first pipe, a portion of said second and third pipes and said first, second and third valves are arranged in a separate disposal block.

5. The discharge system according to claim 1, wherein an amount of flush water needed when said discharge system is flushed is 0.1 to 0.9 liters.

* * * * *